US012037732B2

(12) United States Patent
You et al.

(10) Patent No.: US 12,037,732 B2
(45) **Date of Patent: *Jul. 16, 2024**

(54) LAUNDRY TREATING APPARATUS

(71) Applicant: LG ELECTRONICS INC., Seoul (KR)

(72) Inventors: Jungsang You, Seoul (KR); Yongwoo Kwon, Seoul (KR); Minsoo Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/741,888

(22) Filed: May 11, 2022

(65) Prior Publication Data

US 2022/0267940 A1 Aug. 25, 2022

Related U.S. Application Data

(63) Continuation of application No. 16/694,524, filed on Nov. 25, 2019, now Pat. No. 11,359,323.

(30) Foreign Application Priority Data

Nov. 27, 2018 (KR) ..... 10-2018-0148952
Oct. 23, 2019 (KR) ..... 10-2019-0132496

(51) Int. Cl.
*D06F 37/28* (2006.01)
*D06F 37/22* (2006.01)

(52) U.S. Cl.
CPC ..... *D06F 37/28* (2013.01); *D06F 37/22* (2013.01)

(58) Field of Classification Search
CPC ..... D06F 37/22; D06F 37/28
USPC ..... 68/232
See application file for complete search history.

(56) References Cited

U.S. PATENT DOCUMENTS

| | | | |
|---|---|---|---|
| 6,766,596 | B1 | 7/2004 | Bienick et al. |
| 10,000,879 | B2 | 6/2018 | Kwon et al. |
| 10,094,063 | B2 | 10/2018 | Cheon et al. |
| 2004/0020246 | A1 | 2/2004 | Yun et al. |

(Continued)

FOREIGN PATENT DOCUMENTS

| | | |
|---|---|---|
| CN | 1594712 | 3/2005 |
| CN | 102471977 | 5/2012 |

(Continued)

OTHER PUBLICATIONS

Russian Office Action dated Feb. 18, 2020 issued in Application 2019138124/12(075230) and English Translation.

(Continued)

*Primary Examiner* — Tinsae B Ayalew
(74) *Attorney, Agent, or Firm* — KED & Associates LLP

(57) ABSTRACT

The present disclosure provides a laundry treating apparatus, comprising: a body having a laundry introduction opening; and a door configured to open and close the laundry introduction opening, wherein the door includes: a door frame rotatably coupled to the body, and having an opening which faces the laundry introduction opening in a closed state of the door; and a front glass attached to the door frame to thus form a front appearance of the door, and wherein the front glass includes: a transparent region corresponding to the opening; an opaque region formed to enclose the transparent region; and an align mark configured to guide an attachment position of the front glass to the door frame.

17 Claims, 14 Drawing Sheets

(56) References Cited

U.S. PATENT DOCUMENTS

| | | | |
|---|---|---|---|
| 2006/0090523 | A1 | 5/2006 | Lyu |
| 2010/0031581 | A1 | 2/2010 | Kang et al. |
| 2011/0025177 | A1 | 2/2011 | Schöne |
| 2013/0152641 | A1 | 6/2013 | Carrillo |
| 2014/0210324 | A1 | 7/2014 | Kilgore et al. |
| 2017/0030001 | A1 | 2/2017 | Anderson et al. |
| 2017/0121880 | A1 | 5/2017 | Cheon et al. |
| 2017/0121884 | A1 | 5/2017 | Kwon et al. |
| 2017/0121891 | A1 | 5/2017 | Cheon et al. |

FOREIGN PATENT DOCUMENTS

| | | |
|---|---|---|
| CN | 103917378 | 7/2014 |
| CN | 204919118 | 12/2015 |
| CN | 105518205 | 4/2016 |
| CN | 106012441 | 10/2016 |
| CN | 106048967 | 10/2016 |
| CN | 106906622 | 6/2017 |
| DE | 20 2009 005678 | 6/2009 |
| EP | 1884585 | 2/2008 |
| EP | 2 434 046 | 3/2012 |
| EP | 3 162 945 | 5/2017 |
| JP | 2004-065957 | 3/2004 |
| JP | 2005-058753 | 3/2005 |
| JP | 2017-169928 | 9/2017 |
| JP | 2018-532545 | 11/2018 |
| JP | 2018-532548 | 11/2018 |
| KR | 2003-0060557 | 7/2003 |
| KR | 20040011219 | 2/2004 |
| KR | 20050122471 | 12/2005 |
| KR | 20060085854 | 7/2006 |
| KR | 10-2010-0065961 | 6/2010 |
| KR | 10-1708351 | 2/2017 |
| KR | 10-1708354 | 2/2017 |

OTHER PUBLICATIONS

Extended European Search Report dated Mar. 25, 2020 issued in Application 19211637.4.

Australian Office Action dated Jun. 2, 2020 issued in AU Application No. 2019271949.

Japanese Office Action dated Nov. 17, 2020 issued in Application 2019-213064.

United States Office Action dated Aug. 2, 2021 issued in co-pending related U.S. Appl. No. 16/694,524 (p. 1638).

Japanese Office Action dated Sep. 7, 2021 issued in Application 2019-213064.

Korean Office Action issued in Application No. 10-2019-0132496 dated Oct. 27, 2021.

Chinese Office Action dated Nov. 25, 2021 issued in CN Application No. 201911180845.2.

Chinese Office Action dated Apr. 4, 2023 issued in Application No. 202210748547.4.

Chinese Office Action dated Aug. 23, 2023, issued in Application No. 202210748547.4.

LAUNDRY TREATING APPARATUS

CROSS-REFERENCE TO RELATED APPLICATION

This application is a Continuation application of U.S. patent application Ser. No. 16/694,524 filed Nov. 25, 2019, which claims priority under 35 U.S.C. § 119 to Korean Patent Application No. 10-2018-0148952, filed Nov. 27, 2018, and Korean Patent Application No. 10-2019-0132496, filed Oct. 23, 2019, the subject matter of which are incorporated herein by reference.

BACKGROUND

1. Field

The present disclosure relates to a laundry treating apparatus having a door configured to open and close a laundry introduction opening of a body.

2. Background

A laundry treating apparatus may include an apparatus for washing laundry (or clothes), an apparatus for drying laundry, and an apparatus for washing and drying laundry together. In the laundry treating apparatus, washing laundry is a stroke of removing contaminants from the laundry through reaction between water and detergents, and drying laundry is a stroke of removing moisture contained in the laundry by use of a hot air supply device provided in the laundry treating apparatus.

A laundry treating apparatus may include a body having a laundry introduction opening, and a door configured to open and close the laundry introduction opening. In an example in which the door includes a circular front glass, a mechanical object (a pin, a hook, etc.) for guiding a precise attachment position when a door frame is coupled to the front glass, can not be formed at the front glass due to a characteristic of glass. Further, there may be no physical reference point for locating the front glass to a proper position of the door frame, due to a characteristic of the circular shape.

Accordingly, an alignment structure for attaching a circular front glass to a proper position of a circular door frame should be provided, and research on a method to make the alignment structure invisible from the outside of a door may be required.

An adhesive may be used to attach the front glass to the door frame. According to experimental results, the amount of an adhesive to be applied, and the time taken for an adhesive filled in an adhesive gun to harden are variable according to an adhesive application method. Thus, research may be ongoing for a method capable of reducing the amount of an adhesive to be applied, and capable of prolonging time taken for an adhesive filled in an adhesive gun to harden.

BRIEF DESCRIPTION OF THE DRAWINGS

Arrangements and embodiments may be described in detail with reference to the following drawings in which like reference numerals refer to like elements, and wherein.

DETAILED DESCRIPTION

A laundry treating apparatus according to the present disclosure may be described in detail with reference to the accompanying drawings.

A singular representation may include a plural representation unless it represents a definitely different meaning from the context.

The same or equivalent components may be provided with the same or similar reference numbers, even in different embodiments, and description thereof will not be repeated.

In describing the present disclosure, if a detailed explanation for a related known function or construction is considered to unnecessarily divert the gist of the present disclosure, such explanation may have been omitted but would be understood by those skilled in the art.

The accompanying drawings may be used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
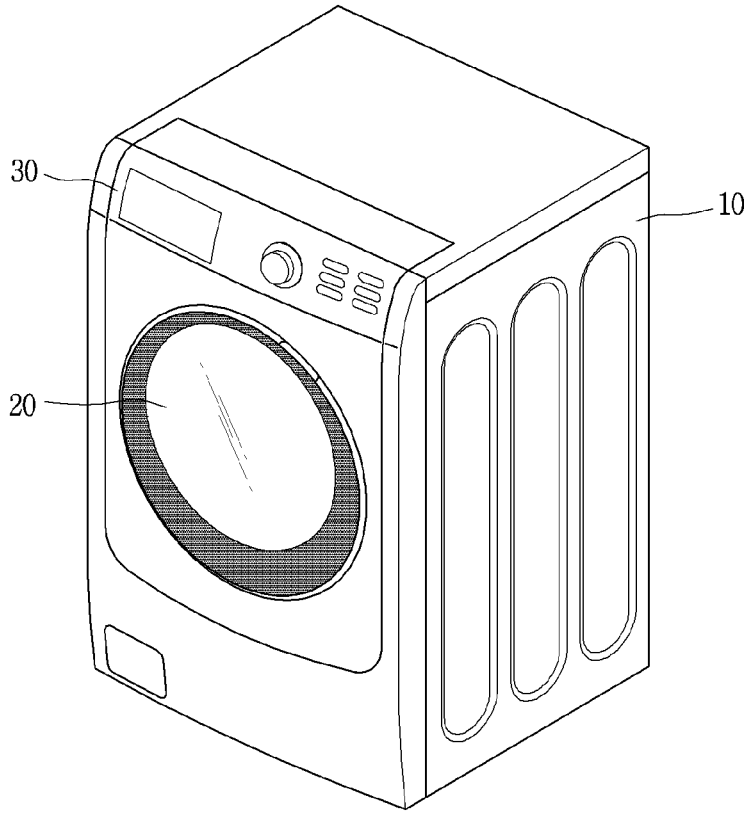
FIG. 1 is a perspective view showing an embodiment of a laundry treating apparatus according to the present disclosure.

FIG. 1 is a perspective view showing an embodiment of a laundry treating apparatus according to the present disclosure. Other embodiments and configurations may also be provided.

Referring to FIG. 1, the laundry treating apparatus may include a body 10, a controller 30 and a door 20.

The body 10 may form the appearance of the laundry treating apparatus, and is provided with a laundry introduction opening for introducing laundry therein. In this example embodiment, the laundry introduction opening is formed on a front surface of the body 10 having a hexahedron shape. The laundry introduction opening may also be formed to have a circular shape.

A laundry accommodation portion, an inner space communicated with the laundry introduction opening, may be provided in the body 10. Laundry may be accommodated in the laundry accommodation portion through the laundry introduction opening.

As an example, if the laundry treating apparatus is configured as a laundry drying apparatus, the laundry accommodation portion may be configured as a drum rotatably provided in the body 10.

As another example, if the laundry treating apparatus is configured as an apparatus for washing and drying laundry, the laundry accommodation portion may be configured as a tub provided in the body 10 and configured to store washing water, and a drum rotatably provided in the tub and configured to accommodate laundry therein.

The controller 30 may be configured to display visual information related to a stroke performed in the laundry treating apparatus to a user, and to receive a user's manipulation (or input). The controller 30 may be provided with a display for displaying visual information, and a knob or a button for receiving an input. Alternatively, the controller 30 may be configured as a touch screen having the above two functions.

The controller 30 may be provided at the body 10 or the door 20. As shown in FIG. 1, the controller 30 is positioned at an upper part of the body 10, above the door 20.

The door 20 may be configured to be relatively moveable with respect to the body 10 in order to open and close the laundry introduction opening. The door 20 may be configured to be relatively moveable with respect to the body 10 through a hinge unit 24 (or hinge device).

Hereinafter, the door 20 may be explained in more detail.

Figure 2:
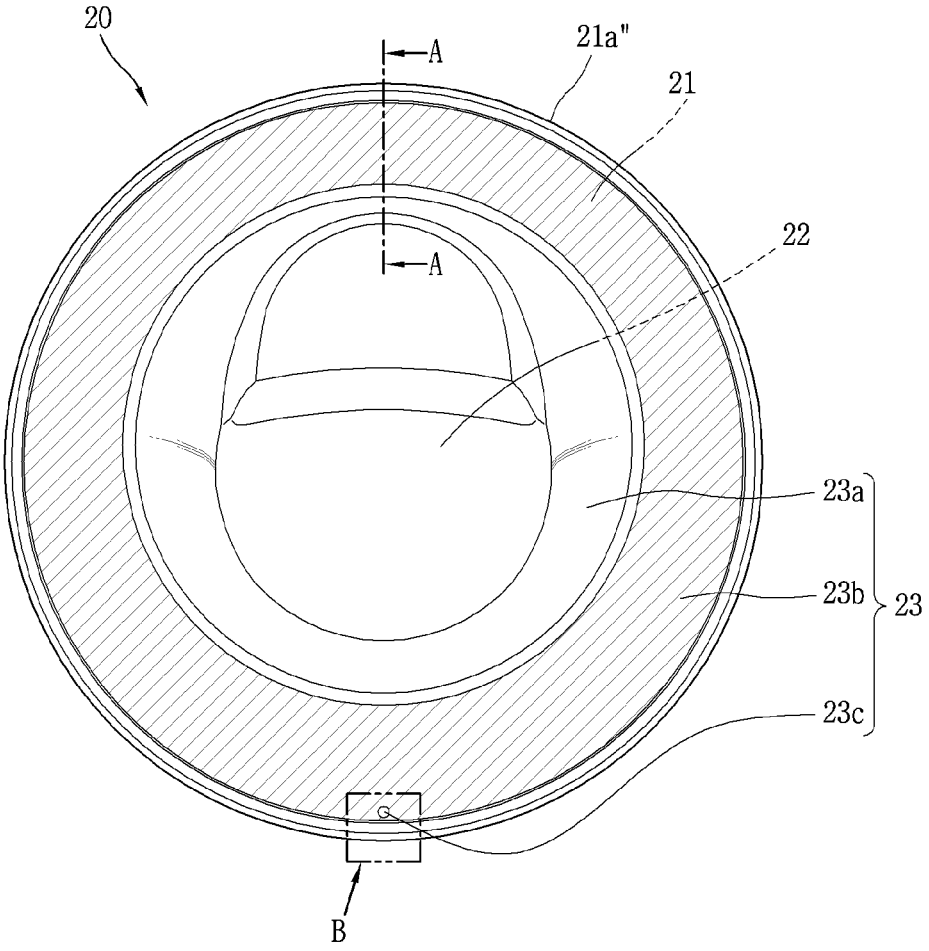
FIG. 2 is a frontal view of a door shown in FIG. 1.
Figure 3:
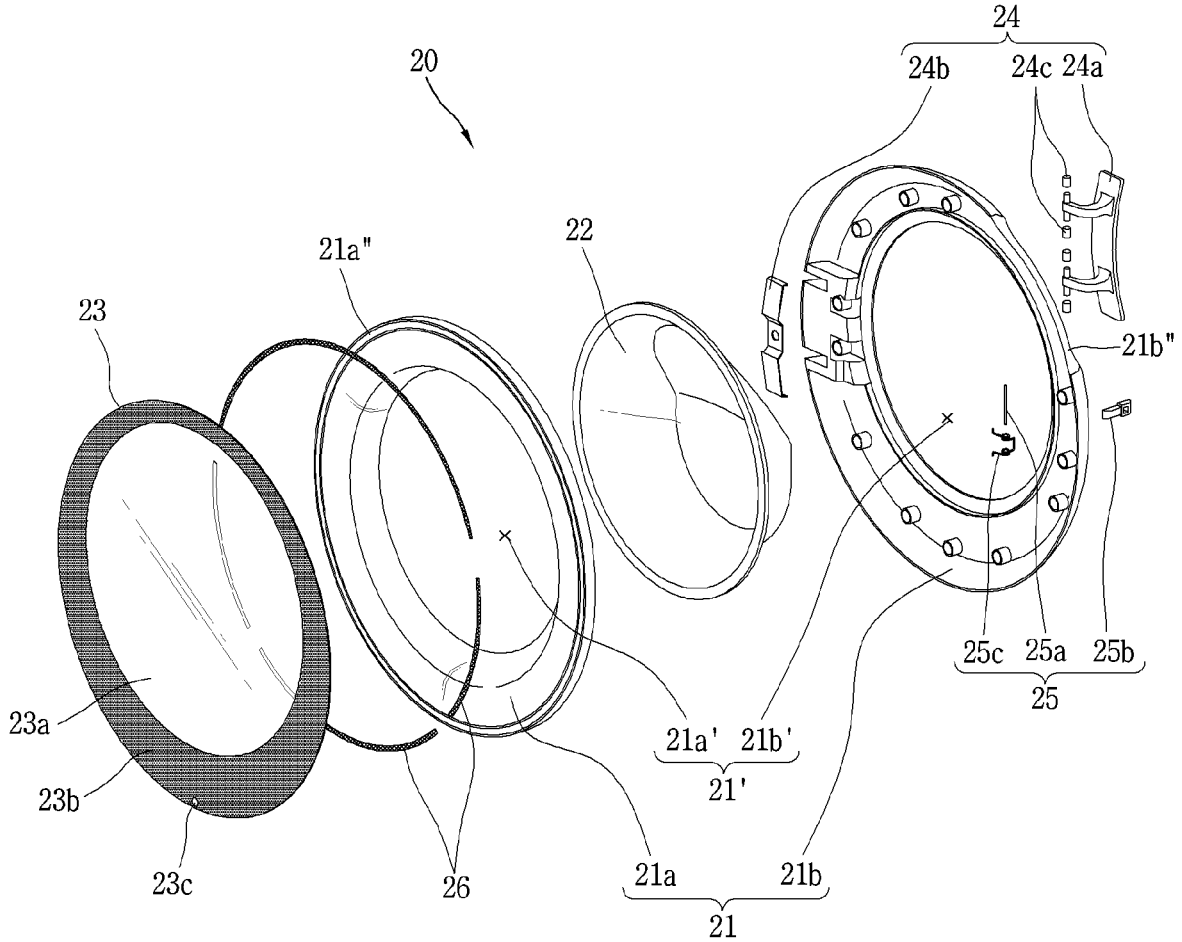
FIG. 3 is a disassembled perspective view of the door shown in FIG. 2.
Figure 4:
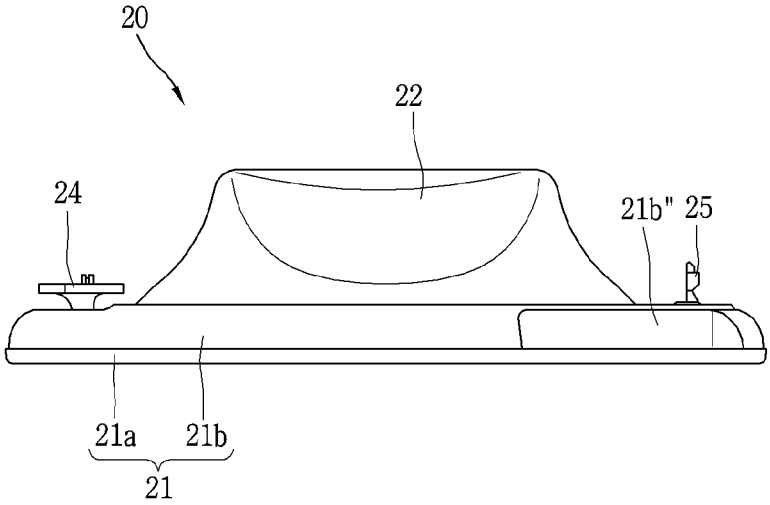
FIG. 4 is a planar view of the door shown in FIG. 2.
Figure 5:
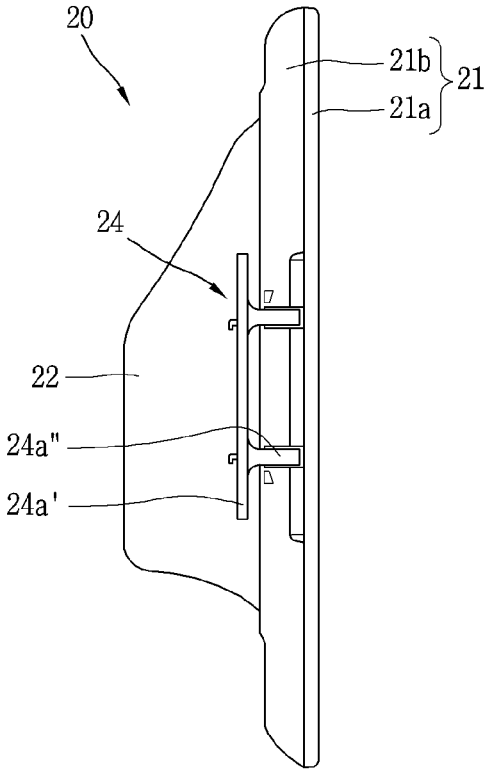
FIG. 5 is a left side surface view of the door shown in FIG. 2.
Figure 6:
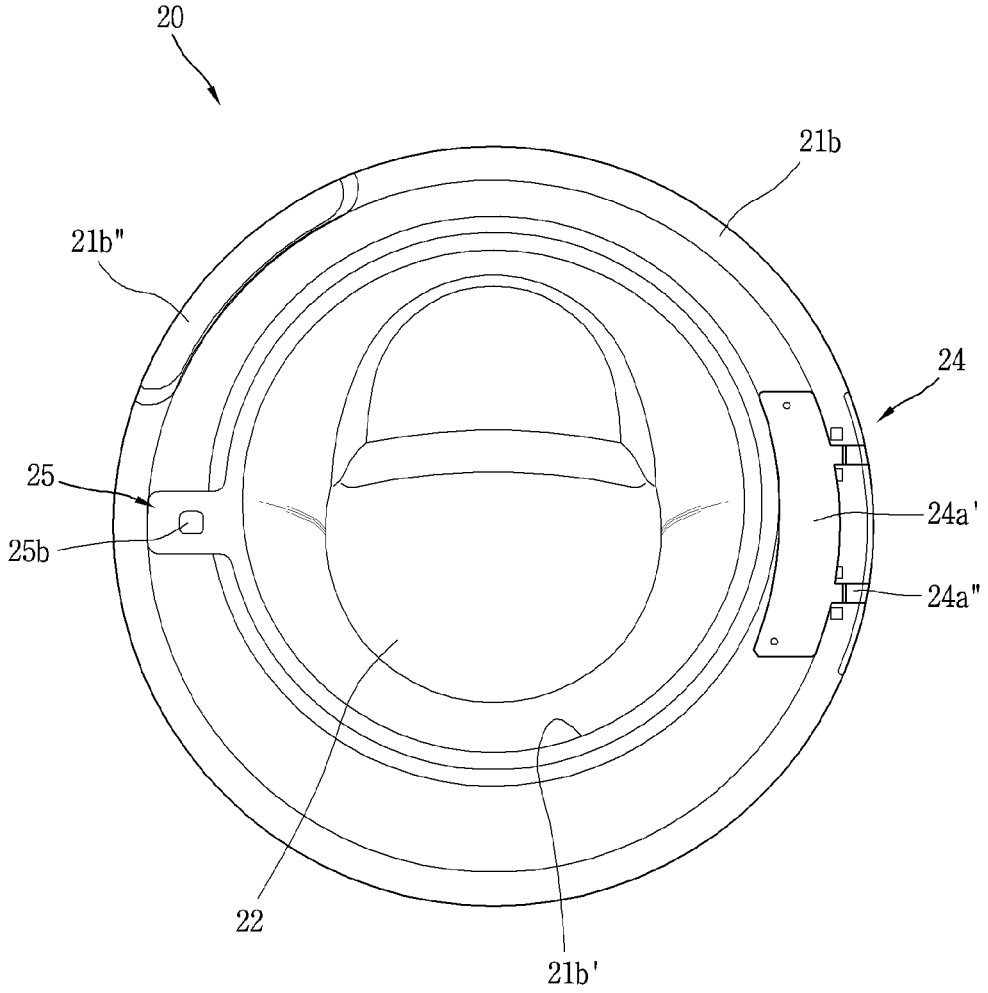
FIG. 6 is a rear view of the door shown in FIG. 2.

FIG. 2 is a frontal view of the door 20 shown in FIG. 1. FIG. 3 is a disassembled perspective view of the door 20 shown in FIG. 2. FIG. 4 is a planar view of the door 20 shown in FIG. 2. FIG. 5 is a left side surface view of the door 20 shown in FIG. 2. FIG. 6 is a rear view of the door 20 shown in FIG. 2. Other embodiments and configurations may also be provided.

Referring to FIGS. 2 to 6, the door 20 may include a door frame 21, a door window 22 and a front glass 23.

The door frame 21 may be rotatably coupled to the body 10 by the hinge unit 24. The door frame 21 may include an outer frame 21*a* and an inner frame 21*b*. The outer frame 21*a* and the inner frame 21*b* may be formed of a synthetic resin material (e.g., an ABS material, a PC material, etc.).

Each of the outer frame 21*a* and the inner frame 21*b* may be formed to have a ring shape. The outer frame 21*a* and the inner frame 21*b* may be coupled to each other by being arranged to be overlapped to each other in back and forth directions. Each of the outer frame 21*a* and the inner frame 21*b* may be provided with a hook on an outer circumferential part thereof to be coupled to each other.

Each of the outer frame 21*a* and the inner frame 21*b* may be formed to have its width changed in a circumferential direction.

That is, a distance (a width) between an outer diameter of the outer frame 21*a* and an inner diameter (a diameter of an opening) may be configured to be increased (widened) towards a lowermost end from an uppermost end. Likewise, a distance (a width) between an outer diameter of the inner frame 21*b* and the inner diameter (the diameter of the opening) may be configured to be increased (widened) towards a lowermost end from an uppermost end.

A protection layer may be formed on a front surface and an outer circumferential surface of the outer frame 21*a*, by a chrome plating. The outer frame 21*a* may be completely immersed in a chrome plating solution for a chrome plating, and a protection layer can be formed on the entire surface of the outer frame 21*a*.

The inner frame 21*b* may be completely immersed in a chrome plating solution for a chrome plating, and a protection layer can be formed on the entire surface of the inner frame 21*b*.

The protection layer may be configured to coat a silver metallic luster on the outer frame 21*a*. Under the configuration, there is an effect that the protection layer looks like circular water drops by the bright silver color. Further, the protection layer may cause a sophisticated feeling when seen by naked eyes.

For ease of reference, names of the outer frame 21*a* and the inner frame 21*b* originate from the outer frame 21*a* is towards the outside of the body 10, and the inner frame 21*b* is towards the inside of the body 10, based on the door frame 21 itself when the door 20 is in a closed state. Without such a distinction, the outer frame 21*a* and the inner frame 21*b* may be referred to as a first frame and a second frame, respectively.

The door frame 21 is provided with an opening 21' which faces the laundry introduction opening in a closed state of the door 20. The opening 21' may be formed to be concentric with the door frame 21. Alternatively, as shown, the opening 21' may be formed to be eccentric from the door frame 21. The opening 21' may be formed to have a circular shape.

The opening 21' may be referred to as a door window hole in that the door window 22 is installed at the opening 21'. For formation of the opening 21', openings 21*a*', 21*b*' are formed at the outer frame 21*a* and the inner frame 21*b*, respectively.

A recess portion 21*b*" may be formed at the inner frame 21*b*. In a closed state of the door 20, a user may open the door 20 by pulling the door 20 by putting his or her hand into the recess portion 21*b*".

The door window 22 may be installed at the door frame 21 in correspondence to the opening 21'. The door window 22 is formed of a synthetic resin material having a transparency, and is arranged to correspond to the laundry introduction opening in a closed state of the door 20.

The door window 22 may be formed of a glass material, and an outer periphery of the door window 22 may be inserted for coupling between the outer frame 21*a* and the inner frame 21*b*.

The outer periphery of the door window 22 may be formed as a plane, and may be fixed between a rear end of a curved surface of the outer frame 21*a* and an inner side end of the inner frame 21*b*. Accordingly, the door 20 may be installed so as to be rotatable with respect to the body 10 in back and forth directions, by the hinge unit 24.

As discussed above, the door 20 may be installed so as to be rotatable with respect to the body 10 by the hinge unit 24.

The hinge unit 24 (or hinge device) may include a hinge 24*a*, a hinge holder 24*b*, and a bush 24*c*.

The hinge 24*a* may be fixed to the body 10, and may be rotatably coupled to the door frame 21. The hinge 24*a* may include a base portion 24*a*' fixed to the body 10 in the form of a plate, and a rotation coupling portion 24*a*" protruding from the base portion 24*a*' and rotatably coupled to the door frame 21. The rotation coupling portion 24*a*" may be provided in plurality in number, so as to be spaced apart from each other up and down.

The hinge holder 24*b* may be coupled to the door frame 21, and may be configured to restrict separation of the rotation coupling portion 24*a*". The hinge holder 24*b* is arranged to cover the rotation coupling portion 24*a*". The hinge holder 24*b* may be coupled to the hinge holder 24*b*.

The bush 24*c* is inserted into a rotation shaft of the rotation coupling portion 24*a*", thereby making the rotation shaft rotate smoothly.

Under a structure that the hinge unit 24 is mounted to one side of the door 20, a locking device 25 for locking or unlocking the door 20 to or from the body 10 is provided at another side of the door 20.

The locking device 25 may include a shaft 25*a*, a door latch 25*b* and an elastic member 25*c*.

The shaft 25*a* is configured to pass through the door latch 25*b*, and is mounted to the door frame 21. The elastic member 25*c* may provide an elastic force for restoration when the door latch 25*b* rotates. Accordingly, the door latch 25*b* is configured to rotate and restore to the door frame 21.

The front glass 23 is attached to the door frame 21, thereby forming the appearance of the front surface of the door 20. The front glass 23 is arranged to cover the opening 21' of the door frame 21. In the drawings, the front glass 23 is attached to the outer frame 21*a*.

Figure 7A:
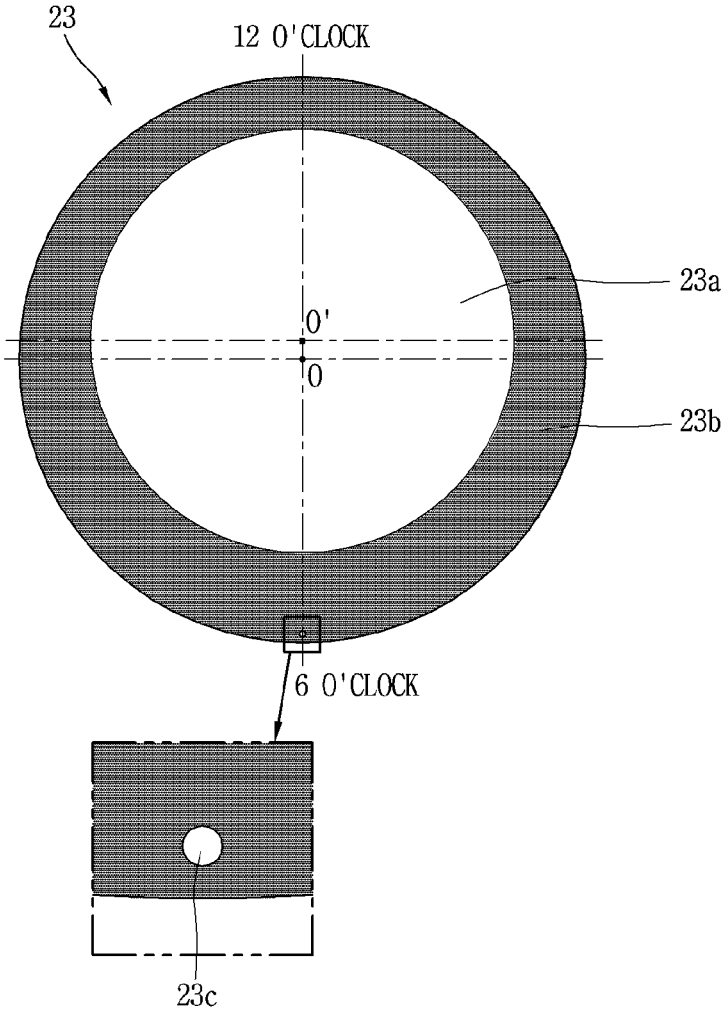
FIG. 7A is a frontal view of a front glass shown in FIG. 3.
Figure 8:
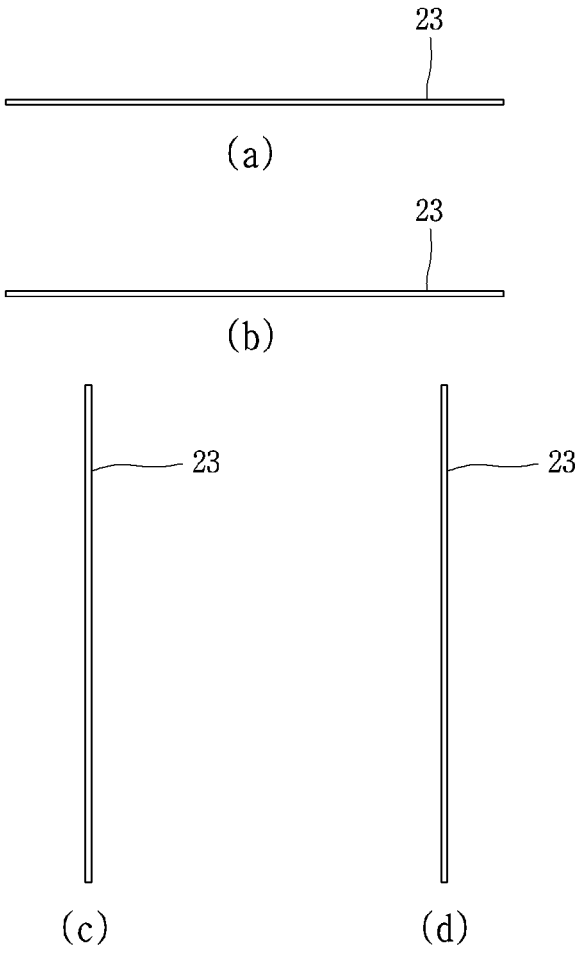
FIG. 8 shows the front glass of FIG. 7A, which is seen from an upper side, a lower side, a left side and a right side, respectively.

FIG. 7A is a frontal view of the front glass 23 shown in FIG. 3. FIG. 8 shows the front glass 23 of FIG. 7A, which is seen from the upper side, the lower side, the left side and the right side, respectively. Other embodiments and configurations may also be provided.

Referring to FIGS. 7A and 8, the front glass 23 includes a transparent region 23*a* and an opaque region 23*b*. The transparent region 23*a* means a region configured to pass at least part of light therethrough, in order to make the opposite side or the inside visible. Thus, the transparent region 23*a* is a concept to include a semi-transparent region 23*a*.

In a state that the front glass 23 has been attached to the door frame 21, the transparent region 23*a* is arranged to correspond to the opening 21' and the door window 22. Thus, in a closed state of the door 20, a user may view the laundry accommodation portion through the transparent region 23*a*.

If a center of the opening 21' is eccentric from a center of the door frame 21, a center (O') of the transparent region 23*a* may be positioned to be eccentric from a center (O) of the front glass 23.

The center (O') of the transparent region 23*a* is located at a position corresponding to the center of the opening 21'. The corresponding position includes not only a complete consistency of the center, but also the same eccentric direction of the center. That is, the center (O') of the transparent region 23*a* and the center of the opening 21' may be consistent with each other, or an eccentric direction of the transparent region 23*a* may be the same as an eccentric direction of the opening 21'.

In the drawings, the center of the opening 21' is positioned to be eccentric from the center of the door frame 21, towards an upper side (a 12 o'clock direction), and the center (O') of the transparent region 23*a* is also positioned to be eccentric from the center (O) of the front glass 23, towards an upper side (a 12 o'clock direction). The center (O') of the transparent region 23*a* may be consistent with the center of the opening 21'.

The opaque region 23*b* is formed to enclose the transparent region 23*a*. The opaque region 23*b* is arranged to cover the remaining part except for the opening 21' of the door frame 21.

The transparent region 23*a* and the opaque region 23*b* which encloses the transparent region 23*a* may be clearly distinguished from each other by the opaque region 23*b*, in the form of a boundary line.

Alternatively, a boundary between the transparent region 23*a* and the opaque region 23*b* may be formed to be indistinct by a halftone technique, for a visual movement from the transparent region 23*a* to the opaque region 23*b*. The opaque region 23*b* may include a plurality of shielding dots formed around the transparent region 23*a*, and the plurality of shielding dots may be formed to have a density lowered towards the transparent region 23*a*.

The front glass 23 may be formed as a complete circle having a preset radius. The front glass 23 is formed of a glass material. Thus, the front glass 23 is formed such that a front surface and a rear surface thereof are flat. As shown in FIG. 8, the front glass 23 is formed as a disc having a constant thickness, which is not curved when viewed in any directions (i.e., the upper, lower, right and left sides).

Since the front glass 23 formed of a glass material is formed as a complete circle and the front surface and the rear surface thereof are formed to be flat, a sophisticated feeling of the door 20 may be more enhanced than in the conventional door cover formed of a synthetic resin material and formed as an incomplete circle having a convex front surface.

A transparent align mark 23*c* is formed in the opaque region 23*b*. The transparent align mark 23*c* may also be called a transparent alignment window. The align mark 23*c* is configured to guide an attachment position of the front glass 23 to the door frame 21. In the drawings, the align mark 23*c* of a circular shape is formed at a lower side (a 6 o'clock direction) of the front glass 23. However, the present disclosure is not limited to this example. The align mark 23*c* may be formed to have a polygonal shape or a linear shape. The position of the align mark 23*c* may be variable.

The align mark 23*c* may be formed to have a shape corresponding to the shape of the opaque region 23*b* of the front glass 23.

The align mark 23*c* may be formed of a transparent material formed in the opaque region, thereby guiding an attachment position of the front glass 23.

As discussed above, the align mark 23*c* may be formed to have a circular shape. The align mark 23*c* may be formed to have a circular shape that can point-contact a lowermost end of the front glass 23.

In this example, an attachment position of the front glass 23 to the outer frame 21*a* may be guided as the align mark 23*c* having a circular shape that contacts the lowermost end of the front glass 23. For example, if a lower end of the align mark 23*c* having a circular shape is arranged to point-contact the lowermost end of the front glass 23, an attachment position of the front glass 23 to the outer frame 21*a* may be determined.

The align mark 23*c* may be formed to have a polygonal shape. The align mark 23*c* may be formed to have a polygonal shape of which one edge is positioned to contact the lowermost end of the front glass 23. For example, the align mark 23*c* may be formed to have a polygonal shape of which one edge is configured to contact the lowermost end of the front glass 23.

Figure 7B:
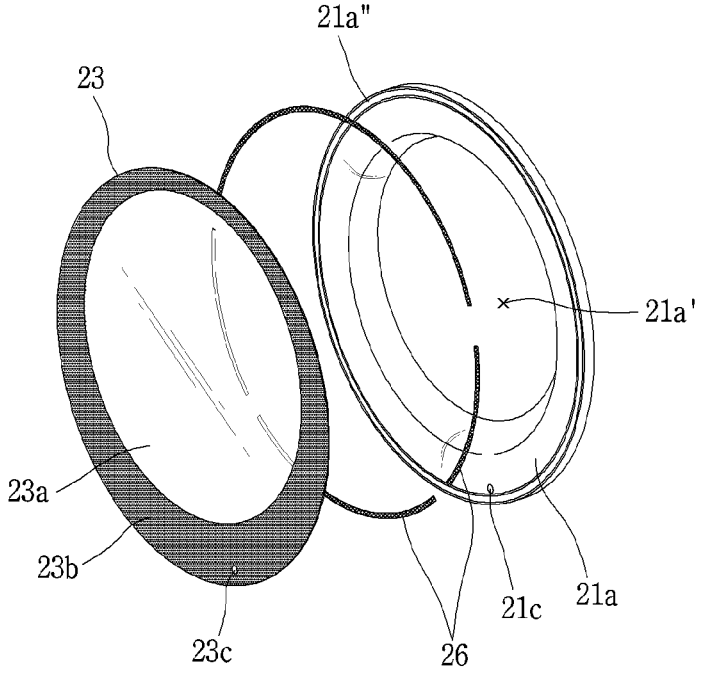
FIG. 7B is a conceptual view showing a state that a position of a front glass is guided by an align guide formed at an outer frame.

As shown in FIG. 7B, the position of the front glass 23 may be guided by an align guide 21*c* formed at the outer frame 21*a*.

The align guide 21*c* may be formed at the outer frame 21*a* at a position corresponding to the align mark 23*c*.

As shown in FIG. 7B, the align guide 21*c* may be formed at one side of the outer frame 21*a* at a position corresponding to the align mark 23*c*. The align guide 21*c* may be formed at one side of a front surface of the outer frame 21*a*, and may mean an indicator having a circular shape or a polygonal shape to correspond to the align mark 23*c*.

For example, if the align mark 23*c* formed at the opaque region has a circular shape, the align guide 21*c* may be also formed to have a circular shape of a corresponding size. If the align mark 23*c* formed at the opaque region has a polygonal shape, the align guide 21*c* may be also formed to have a polygonal shape in correspondence thereto.

That is, the align guide 21*c* may guide the position of the front glass 23 to be attached to the door frame, by being arranged to be overlapped with the align mark 23*c*.

Figure 7C:
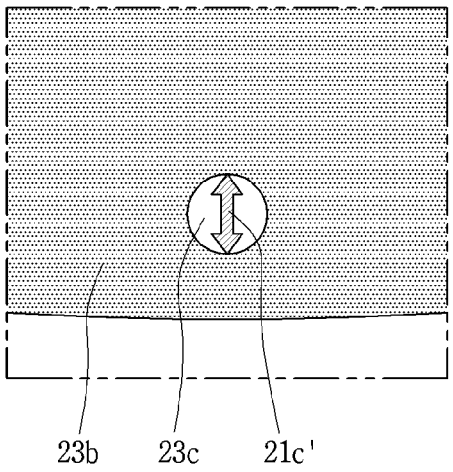
FIG. 7C is a conceptual view showing an arrangement relation between an align guide and an align mark.

As shown in FIG. 7C, the align guide 21*c* may be formed to have a shape of an arrow 21*c'*.

In an example in which the front glass 23 is mounted to the door frame 21, one end of the arrow 21*c*' which constitutes the align guide 21*c* is arranged to contact one end of the align mark 23*c*. This may allow the position of the front glass 23 to be attached to the door frame 21, to be set more precisely.

The align guide 21*c* is formed at one side of the front surface of the outer frame 21*a*, and both ends of the arrow 21*c*' which constitutes the align guide 21*c* are arranged to contact both ends of the align mark 23*c*, respectively. This may allow the position of the front glass 23 to be attached to the door frame 21, to be determined more precisely.

A method for aligning the position of the front glass 23 by using the align mark 23*c* may be explained later.

The front glass 23 may implement the transparent region 23*a*, the opaque region 23*b* and the align mark 23*c*, by the following layer structure.

For example, the front glass 23 may include a glass body formed of a glass material having a transparency, and a shielding layer arranged to cover a rear surface of the glass body and forming the opaque region 23*b*. A part where the shielding layer is not arranged may form the transparent region 23*a* and the align mark 23*c*. The shielding layer may be formed by being glass-printed on the rear surface of the glass body.

As another example, the front glass 23 may include a glass body formed of a glass material having a transparency, and a film arranged to cover the rear surface of the glass body. The film may include a transparent part formed to have a transparency in correspondence to the transparent region 23*a*, an opaque part formed to have a non-transparency in correspondence to the opaque region 23*b*, and an align part formed to have a transparency in correspondence to the align mark 23*c*.

As still another example, the front glass 23 may include a glass body formed of a glass material having a transparency, and a film arranged to cover the rear surface of the glass body. This example is differentiated from the above example in that the film includes a first hole formed to correspond to the transparent region 23*a*, an opaque part formed to have a non-transparency in correspondence to the opaque region 23*b*, and a second hole formed to correspond to the align mark 23*c*. That is, there is a difference in that a part of the film, corresponding to the transparent region 23*a* and the align mark 23*c*, is formed to have a transparency, or is punched.

Figure 9:
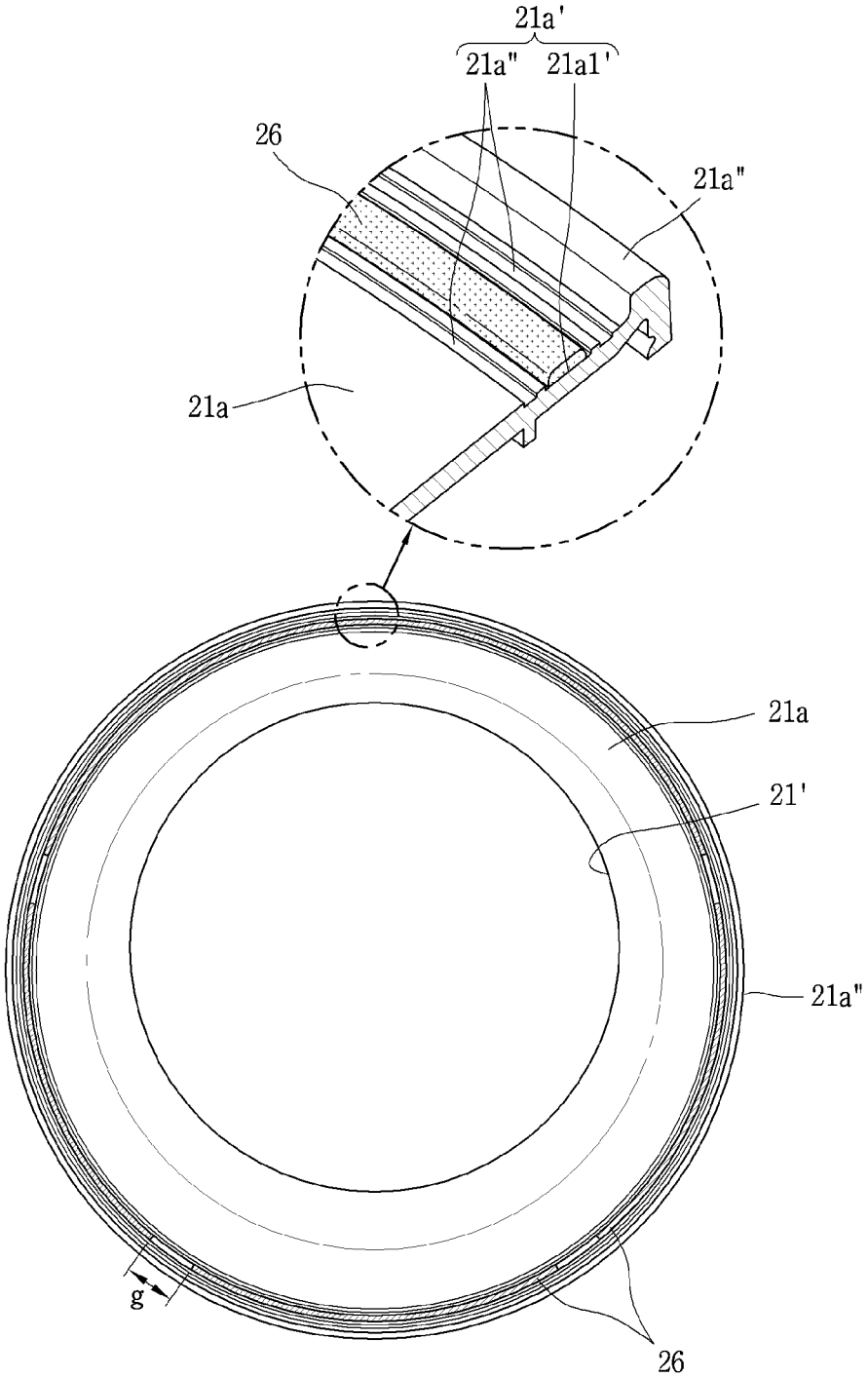
FIG. 9 is a frontal view of a door frame shown in FIG. 3.
Figure 10:
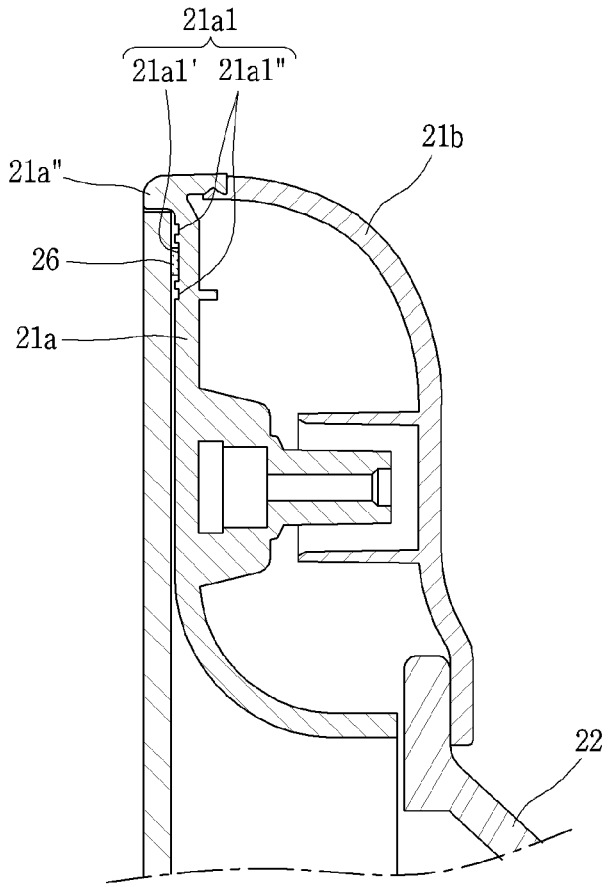
FIG. 10 is a sectional view taken along line 'A-A' in FIG. 2.

FIG. 9 is a frontal view of the door frame 21 shown in FIG. 3. FIG. 10 is a sectional view taken along line 'A-A' in FIG. 2. Other embodiments and configurations may also be provided.

Referring to FIGS. 9 and 10, the door frame 21 may include the outer frame 21*a* and the inner frame 21*b*.

The front glass 23 is configured to be attached to the front surface of the outer frame 21*a*. The inner frame 21*b* is coupled to a rear side of the outer frame 21*a*. The outer frame 21*a* and the inner frame 21*b* may be coupled to each other by a pin-groove coupling, a hook coupling, a screw coupling, a bonding coupling, etc.

A mounting guide 21*a*" may be formed to protrude along a circumference of the outer frame 21*a*. The mounting guide 21*a*" is formed to extend in a ring shape, and forms a space to accommodate the front glass 23 therein.

The mounting guide 21*a*" is arranged to enclose an outer circumferential surface of the front glass 23. The mounting guide 21*a*" is formed to have a preset inner diameter. That is, the mounting guide 21*a*" is formed to have a complete circular shape. The inner diameter of the mounting guide 21*a*" may correspond to an outer diameter of the front glass 23.

The mounting guide 21*a*" may protrude by a predetermined height, so as to form the same plane as an upper surface of the front glass 23. Under the configuration, since there is no stepped-pulley between the mounting guide 21*a*" and the front glass 23, a more simple appearance may be implemented.

The mounting guide 21*a*" is formed to protrude forward from an outer circumferential end of the front surface of the outer frame 21*a*, so as to enclose an outer circumferential surface of the front glass 23. The mounting guide 21*a*" may support a load of the front glass 23, and may protect the side surfaces of the front glass 23 from an external impact.

A protruding length of the mounting guide 21*a*" may be formed to cover at least ⅔ of a thickness of the front glass 23, approximately. If the protruding length of the mounting guide 21*a*" is too short, an external impact may be applied to the outer circumferential surface of the front glass 23, and the load of the front glass can not be supported sufficiently.

The mounting guide 21*a*" may protrude from an edge part of the front surface of the outer frame 21*a*. The mounting guide 21*a*" may be formed in a ring shape, and may form a space to accommodate the front glass 23 therein.

The mounting guide 21*a*" may be formed to have a preset inner diameter, and may be formed in a circular shape. The inner diameter of the mounting guide 21*a*" may have a size corresponding to the outer diameter of the front glass 23. The mounting guide 21*a*" may be configured to enclose the outer circumferential surface of the front glass 23.

An adhesive 26 may be provided (or arranged) between the door frame 21 and the front glass 23, for a coupling therebetween. An adhesive filling groove 21*a*1 for filling the adhesive 26 is formed at the door frame 21. In the drawings, the adhesive filling groove 21*a*1 is formed on the front surface of the outer frame 21*a*.

The adhesive filling groove 21*a*1 is formed in a ring shape having a preset radius, along a circumference of the mounting guide 21*a*" so as to enclose the opening 21'. An interval between the mounting guide 21*a*" and the adhesive filling groove 21*a*1 may be constantly maintained along the circumference of the mounting guide 21*a*". That is, a center of the adhesive filling groove 21*a*1 may correspond to a center of the mounting guide 21*a*".

As shown, the adhesive filling groove 21*a*1 may include an adhesive application part 21*a*1' and adhesive collection parts 21*a*1".

The adhesive application part 21*a*1' is a part for applying the adhesive 26, and is formed in a ring shape which encloses the opening 21' of the door frame. An interval between the mounting guide 21*a*" and the adhesive application part 21*a*1' may be constantly maintained along the circumference of the mounting guide 21*a*". In this example, a center of the adhesive application part 21*a*1' corresponds to the center of the mounting guide 21*a*". Further, since the mounting guide 21*a*" is formed to enclose an outer circumference of the front glass 23 having a complete circular shape, the center of the adhesive application part 21*a*1' may also corresponds to a center of the front glass 23.

The adhesive collection parts 21*a*1" configured to collect the adhesive 26 which leaks to the inside and the outside of the adhesive application part 21*a*1' are provided at both sides of the adhesive application part 21*a*1'. The adhesive collection parts 21*a*1" may be formed to extend in parallel along the adhesive application part 21*a*1' in a spaced state from the adhesive application part 21*a*1' by a predetermined interval.

That is, the adhesive collection parts 21*a*1" includes a first adhesive collection part of a ring shape which encloses the adhesive application part 21*a*1', and a second adhesive collection part of a ring shape positioned in the adhesive application part 21*a*1'. That is, the adhesive application part 21*a*1' is formed to enclose the second adhesive collection part. A center of the first adhesive collection part and a center of the second adhesive collection part correspond to the center of the adhesive application part 21*a*1'.

The adhesive application part 21*a*1' is a part where the adhesive 26 is applied, and the adhesive collection parts 21*a*1" are provided against an overflow of the adhesive 26. Accordingly, the adhesive collection parts 21*a*1" may have a narrower width than the adhesive application part 21*a*1'.

Under the structure, in the process of coupling the front glass 23 to the outer frame 21*a*, even if the adhesive 26 filled in the adhesive collection parts 21*a*1" leaks, the adhesive 26 may be collected to the adhesive collection parts 21*a*1" provided at the inside and the outside of the adhesive application part 21*al*. This may prevent a lowering of appearance quality due to leakage of the adhesive 26.

Under the structure, the adhesive application part 21*a*1' may be arranged to be close to an edge part of the outer frame 21*a*, to the maximum. Since a corresponding non-coupling part of an edge part of the front glass 23 is minimized, a coupling intensity may be enhanced.

If a door cover formed of a synthetic resin material is used as the front glass 23, a mechanical object (a pin, a hook, etc.) for guiding a precise attachment position when coupling the door cover to the door frame 21 may be formed at the door cover. For example, a pin may be formed on a rear surface of the door cover, and a groove for inserting the pin may be formed at the door frame 21. Then, by a pin-groove coupling, the door cover may be attached to a proper position of the door frame 21.

However, if the front glass 23 formed of a glass material is used, there may be a problem that a mechanical object for guiding a precise attachment position when coupling the front glass to the door frame 21 can not be formed at the front glass 23. Therefore, the front glass 23 should be attached to a proper position of the door frame 21 by another method.

An apparatus for attaching the front glass 23 to a proper position of the door frame 21, and a method for fabricating the door 20 by using the apparatus will be explained.

Figure 11:
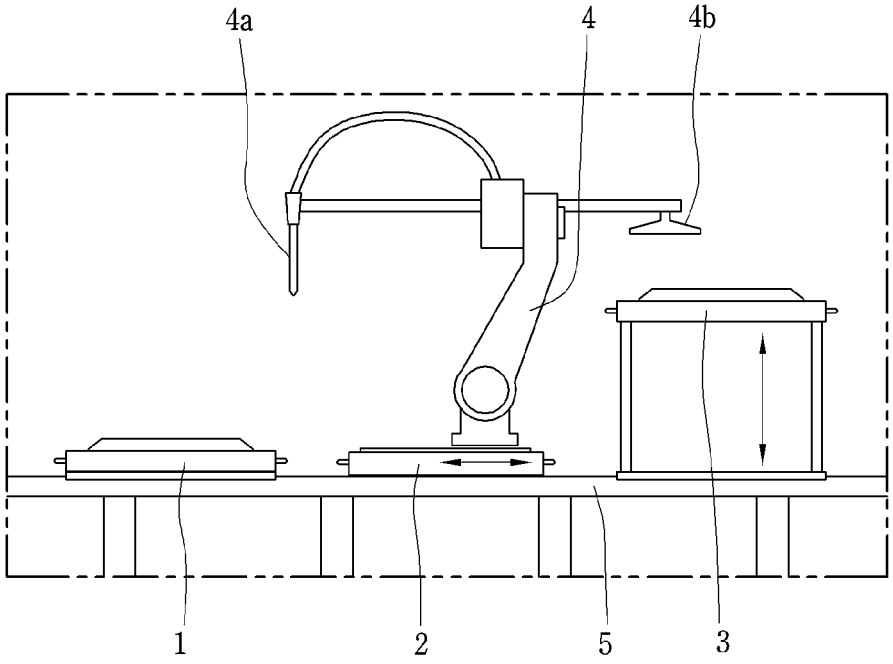
FIG. 11 is a conceptual view schematically showing an apparatus for attaching a front glass (shown in FIG. 3) to a proper position of a door frame.

FIG. 11 is a conceptual view schematically showing an apparatus for attaching the front glass 23 (shown in FIG. 3) to a proper position of the door frame 21. Other embodiments and configurations may also be provided.

Referring to FIG. 11, the apparatus includes a front glass mounting jig 1, a door frame mounting jig 2, a compression jig 3, and a robot arm 4.

The door frame mounting jig 2 is formed to be horizontally moveable through an automated rail 5. The automated rail 5 is formed to extend up to the compression jig 3, so that the door frame mounting jig 2 is moveable up to the compression jig 3.

The robot arm 4 has a movement range for covering the front glass mounting jig 1 and the door frame mounting jig 2 (the initial position). The robot arm 4 is provided with an adhesive gun 4*a* and an absorbing part 4*b*.

A method for fabricating the door 20 by using the apparatus will be explained.

Figure 12:
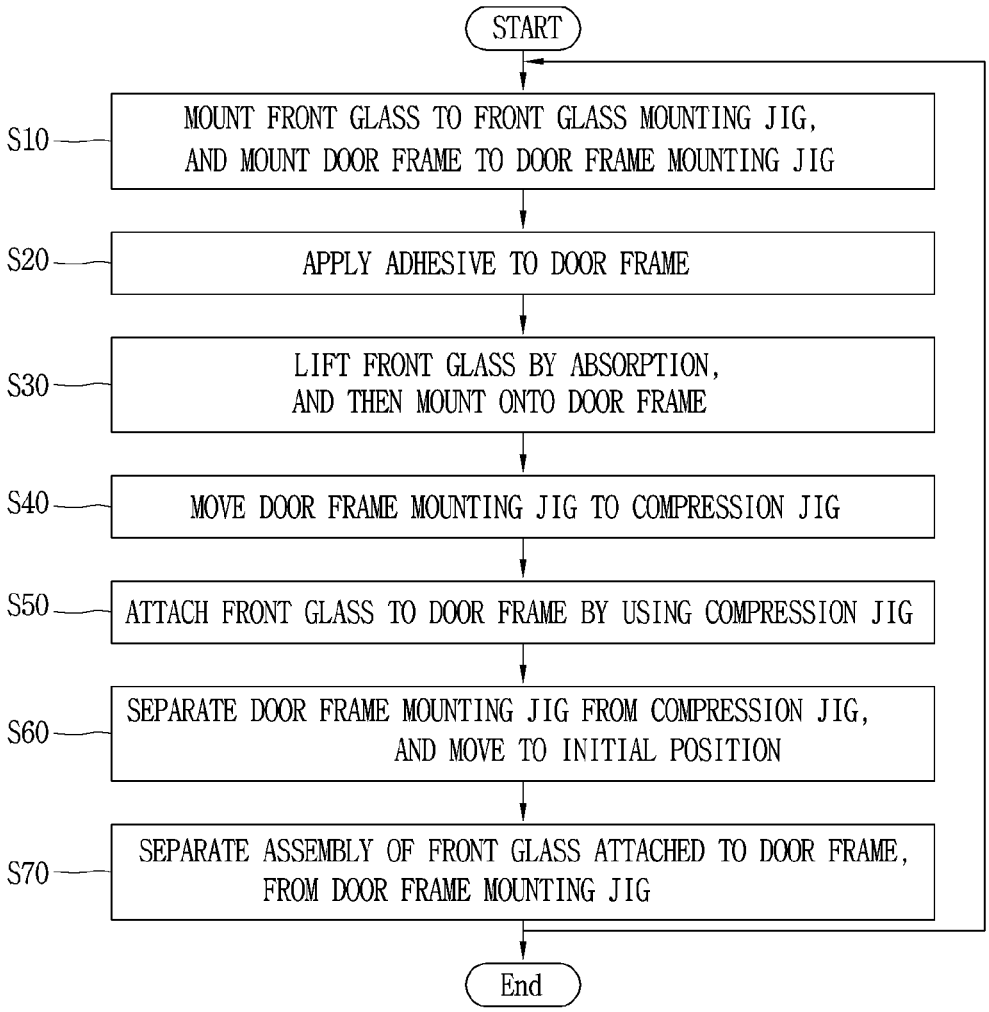
FIG. 12 is a flow chart for explaining an assembly process of a front glass and a door frame, using the apparatus of FIG. 11.

FIG. 12 is a flow chart for explaining an assembly process of the front glass 23 and the door frame 21, using the apparatus of FIG. 11. Other operations and orders of operations may also be provided.

Referring to FIG. 12, the front glass 23 is mounted to the front glass mounting jig 2, and the door frame 21 is mounted to the door frame mounting jig 2 (S10). The two processes (or operations) may be performed regardless of the order.

As can be seen from the fabrication method to be explained later, a position of the front glass 23 mounted to the front glass mounting jig 1 is an attachment position of the front glass 23 to the door frame 21. Thus, the front glass 23 should be mounted to a proper position of the front glass mounting jig 1.

Figure 13:
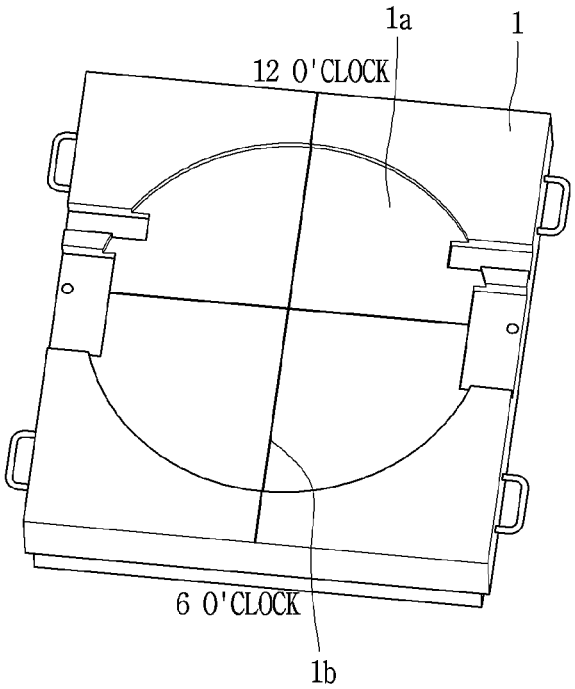
FIG. 13 is a conceptual view of a front glass mounting jig shown in FIG. 11.
Figure 14:
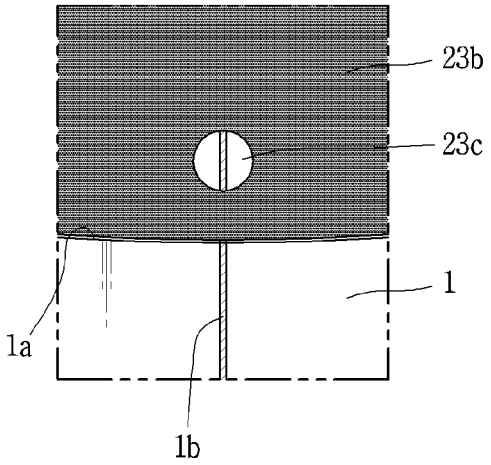
FIG. 14 is a conceptual view for explaining a method for mounting a front glass to a proper position of a front glass mounting jig in FIG. 12.

FIG. 13 is a conceptual view of the front glass mounting jig shown in FIG. 11. FIG. 14 is a conceptual view for explaining a method for mounting the front glass 23 to a proper position of the front glass mounting jig 1 (in FIG. 12). Other embodiments and configurations may also be provided.

Referring to FIG. 13, the front glass mounting jig 1 is provided with a front glass mounting portion 1*a* recessed from an upper surface. The front glass mounting portion 1*a* is formed to have a size corresponding to the front glass 23. Thus, an inner circumferential surface of the front glass mounting portion 1*a* may be arranged to face an outer circumferential surface of the front glass 23 with a very small preset interval.

Since the front glass 23 is formed to have a circular shape, the front glass 23 may be rotated in a mounted state to the front glass mounting portion 1*a*. That is, a position of the front glass 23 mounted to the front glass mounting portion 1*a* is not limited to a specific position.

In order to guide an attachment position of the front glass 23 to the front glass mounting jig 1, a guide mark 1*b* is formed at the front glass mounting jig 1, and the transparent align mark 23*c* may be formed in the opaque region 23*b* of the front glass 23.

In the drawings, the guide mark 1*b* is formed as a straight line which connects an upper side (a 12 o'clock direction) and a lower side (a 6 o'clock direction) of the front glass 23. However, embodiments of the present disclosure are not limited to this example. That is, the guide mark 1*b* may be formed to have a polygonal shape, a circular shape, a point, etc., and not a line. The position of the guide mark 1*b* may be changed.

Referring to FIG. 14, once the front glass 23 is positioned so that the guide mark 1*b* formed at the front glass mounting jig 1 is seen through the align mark 23*c* of the front glass 23, the front glass 23 is mounted to a proper position of the front glass mounting jig 1.

Referring to FIG. 12, next, the adhesive 26 is applied to the door frame 21 mounted to the door frame mounting jig 2 (S20). The application of the adhesive 26 may be performed precisely by the robot arm 4 and the adhesive gun 4*a* mounted to the robot arm 4. In this example, the robot arm 4 may be configured to move to the door frame mounting jig 2 from an initial position, to apply the adhesive 26 to the door frame 21 by using the adhesive gun 4*a*, and then to return the door frame mounting jig to the initial position.

In a general case, the adhesive 26 may be applied along the adhesive filling groove 21*a*1 at a time (an entire application method). However, in the present disclosure, the adhesive 26 is applied along the adhesive filling groove 21*a*1 formed to enclose the opening 21' of the door frame 21, plural times in a divided manner (a divided application method).

The adhesive 26 applied along the adhesive filling groove 21*a*1 plural times in the divided manner may be distinguished from each other by a predetermined separation interval (g). That is, the adhesive 26 applied each time is arranged with the predetermined separation interval (g). In the drawings, the adhesive 26 is applied at least 4 times.

According to such a divided application method, there is an advantage that the amount of the adhesive 26 to be applied is reduced, even though it takes a more application time than in the aforementioned general entire application method. Further, according to such a divided application method, since the adhesive 26 is supplied to the adhesive gun 4*a* little by little at the time of each application, time taken to harden the adhesive 26 filled in the adhesive gun 4*a* can be prolonged more than in the above mentioned general entire application method.

The absorbing part 4*b* of the robot arm 4 may lift the front glass 23 mounted to the front glass mounting jig 1 in an absorbing manner, and then mount the front glass 23 onto the door frame 21 mounted to the door frame mounting jig 2 (S30). The robot arm 4 may be configured to return to the initial position.

Next, the door frame mounting jig 2 is moved to the compression jig 3 (S40). The door frame mounting jig 2 may be moved to the compression jig 3 through the automated rail 5.

Next, the front glass 23 is attached to the door frame 21 by using the compression jig 3 (S50). In the drawings, the front glass 23 moved to a position below a cover of the compression jig 3 is pressurized by a downward movement of the cover, thereby being attached to the door frame 21.

Next, the door frame mounting jig 2 is separated from the compression jig 3, and the door frame mounting jig is moved to the initial position (S60). In the drawings, the cover is moved to the upper side, the initial position, and the door frame mounting jig 2 returns to the initial position through the automated rail 5.

In the attaching of the front glass 23 to the door frame 21 by using the compression jig 3, and the separating of the door frame mounting jig 2 from the compression jig 3 and moving to the initial position, a part of the adhesive 26 filled in the adhesive gun 4*a* is discarded. This may be done to prevent a blocking of a hole of the adhesive gun 4*a* for applying the adhesive 26.

More specifically, an assembly process of the front glass 23 and the door frame 21 may be repeatedly performed. If the adhesive gun 4*a* is not used after the adhesive 26 is applied to the adhesive filling groove 21*a*1, before the application process is repeated, the adhesive 26 may harden to cause a blocking of the hole of the adhesive gun 4*a*. For prevention of this, a discarding of the part of the adhesive 26 filled in the adhesive gun 4*a* is added in a process while the adhesive 26 is repeatedly applied to the adhesive filling groove 21*a*1.

The amount of the adhesive 26 to be discarded may be set to be larger than the amount of the adhesive 26 to be applied in the aforementioned applying of the adhesive 26 to the door frame 21.

Then, the assembly of the front glass 23 attached to the door frame 21 is separated from the door frame mounting jig 2 (S70).

The align mark 23*c* for attaching the front glass 23 to a proper position of the door frame 21 is formed at the front glass 23 which forms the front appearance of the door 20. Accordingly, if the align mark 23*c* remains as it is, an aesthetic feeling may be degraded externally. Especially, since the align mark 23*c* is formed in the opaque region 23*b* so as to have a transparency, it seems to be more remarkable.

A structure to make the align mark 23*c* invisible from the outside of the door 20 may be explained.

Figure 15:
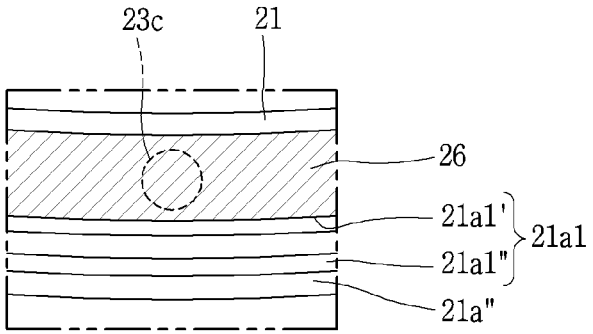
FIG. 15 is an enlarged view of part CB' shown in FIG. 2.

FIG. 15 is an enlarged view of part CB' shown in FIG. 2. In the drawings, for ease of understanding, the front glass 23 is not displayed, but only the align mark 23*c* is displayed.

Referring to FIG. 15, the adhesive 26 is formed of an opaque material, and is arranged to cover the align mark 23*c* at a side of a rear surface of the front glass 23. That is, the align mark 23*c* is positioned to be overlapped on the adhesive 26 applied to the door frame 21. Thus, the align mark 23*c* is blocked by the adhesive 26.

The adhesive 26 may be formed in the same color as the opaque region 23*b* (e.g., black). In this example, the align mark 23*c* may be covered more completely.

As discussed above, the adhesive filling groove 21*a*1 includes the adhesive application part 21*a*1' where the adhesive 26 is applied, and the adhesive collection parts 21*a*1" configured to collect the adhesive 26 which leaks to both sides of the adhesive application part 21*a*1'. In a relation between the front glass 23 and the door frame 21, the align mark 23*c* is arranged to be overlapped with the adhesive application part 21*a*1'.

In the applying of the adhesive 26 to the door frame 21, even if the adhesive 26 is applied along the adhesive application part 21*a*1' plural times in a divided manner, it is set that the adhesive 26 should be applied to an overlapped part with the align mark 23*c*.

The adhesive 26 is arranged to cover the align mark 23*c*, and is formed of an opaque material, preferably, in the same color as the opaque region 23*b*. This may allow the align mark 23*c* for the alignment not to be discerned easily from the outside of the door 20. Accordingly, the appearance of the door 20 may be enhanced.

A first aspect of the present disclosure is to provide a laundry treating apparatus having a front glass formed such that a front surface and a rear surface thereof are flat, the front glass having a complete circular shape.

A second aspect of the present disclosure is to provide an align structure between a front glass and a door frame, at the time of attaching the front glass of a circular shape to the door frame of a circular shape.

A third aspect of the present disclosure is to provide a structure to make the align structure invisible from the outside of a door.

A fourth aspect of the present disclosure is to provide a method capable of minimizing usages of an adhesive for attachment between a front glass and a door frame, and capable of prolonging time taken for the adhesive filled in an adhesive gun to harden.

In order to achieve the first aspect and in accordance with the purpose of this specification, as embodied and broadly described herein, there is provided a laundry treating apparatus, comprising: a body having a laundry introduction opening; and a door configured to open and close the laundry introduction opening, wherein the door includes: a door frame rotatably coupled to the body, and having an opening which faces the laundry introduction opening in a closed state of the door; and a front glass attached to the door frame, forming a front appearance of the door, and including a transparent region corresponding to the opening, and an opaque region formed to enclose the transparent region, and wherein the front glass is formed of a glass material, and is formed as a complete circle which has flat front and rear surfaces and a preset radius.

A mounting guide having a preset inner diameter may be provided at the door frame, the mounting guide protruding to enclose an outer circumferential surface of the front glass, in a ring shape.

An adhesive filling groove for filling an adhesive which attaches the front glass to the door frame, may be formed on a front surface of the door frame. And the adhesive filling groove may be formed in a ring shape having a preset radius, along a circumference of the mounting guide, so as to enclose the opening.

An interval between the mounting guide and the adhesive filling groove may be constantly maintained along the circumference of the mounting guide.

In order to achieve the second aspect and in accordance with the purpose of this specification, as embodied and broadly described herein, there is provided a laundry treating apparatus, comprising: a body having a laundry introduction opening; and a door configured to open and close the laundry introduction opening, wherein the door includes: a door frame rotatably coupled to the body, and having an opening which faces the laundry introduction opening in a closed state of the door; a front glass attached to the door frame, forming a front appearance of the door, and formed to have a circular shape; and an adhesive applied between the door frame and the front glass, and configured to attach the front glass to the door frame, wherein the front glass includes: a transparent region corresponding to the opening; an opaque region formed to enclose the transparent region; and a transparent align mark formed in the opaque region, and configured to guide an attachment position of the front glass to the door frame, and wherein the adhesive is applied (or disposed) to cover the align mark.

Here, the door frame may include: an outer frame arranged so that an outer circumferential part thereof encloses an outer side surface of the front glass; and an inner frame having an outside connected to the outer circumferential part of the outer frame, and having an inside connected to an outer periphery of a door window.

Here, the align mark may be formed to have a shape corresponding to a shape of the opaque region formed at the front glass. Accordingly, the align mark may be formed to have a transparency in the opaque region, and may be configured to guide the attachment position of the front glass.

The align mark may be formed to have a circular shape so as to contact a lowermost end of the front glass. And the align mark may be formed to have a polygonal shape positioned so that one edge contacts a lowermost end of the front glass.

Here, an align guide may be formed at the outer frame, at a position corresponding to the align mark.

The front glass may be formed as a complete circle having a preset radius. And a mounting guide having a preset inner diameter may be provided at the door frame, the mounting guide protruding to enclose an outer circumferential surface of the front glass, in a ring shape.

The front glass may be formed such that a front surface and a rear surface thereof are flat.

A center of the opening may be positioned to be eccentric from a center of the door frame, and a center of the transparent region may be positioned to be eccentric from a center of the front glass.

The center of the transparent region may be located at a position corresponding to the center of the opening.

As an example of the front glass, the front glass may include a glass body formed of a glass material having a transparency; and a shielding layer arranged to cover a rear surface of the glass body and forming the opaque region.

The transparent region and the align mark may be a part where the shielding layer is not arranged.

The shielding layer may be formed by being glass-printed on the rear surface of the glass body.

As another example of the front glass, the front glass may include a glass body formed of a glass material having a transparency; and a film arranged to cover the rear surface of the glass body. And the film may include a transparent part formed to have a transparency in correspondence to the transparent region; an opaque part formed to have a non-transparency in correspondence to the opaque region; and an align part formed to have a transparency in correspondence to the align mark.

As still another example of the front glass, the front glass may include a glass body formed of a glass material having a transparency; and a film arranged to cover the rear surface of the glass body. And the film may include a first hole formed to correspond to the transparent region; an opaque part formed to have a non-transparency in correspondence to the opaque region; and a second hole formed to correspond to the align mark.

Further, in order to achieve the second aspect and in accordance with the purpose of this specification, as embodied and broadly described herein, there is provided a method for fabricating a door provided at a laundry treating apparatus, the method comprising: mounting a front glass to a front glass mounting jig, so that a guide mark formed at the front glass mounting jig is seen through a transparent align mark formed at the front glass; and attaching the front glass to a door frame, wherein the front glass includes a transparent region corresponding to an opening of the door frame; and an opaque region formed to enclose the transparent region, and wherein the align mark is formed in the opaque region.

The front glass may be formed as a complete circle having a preset radius. And a mounting guide having a preset inner diameter may be provided at the door frame, the mounting guide protruding to enclose an outer circumferential surface of the front glass, in a ring shape.

A center of the opening may be positioned to be eccentric from a center of the door frame, and a center of the transparent region may be positioned to be eccentric from a center of the front glass.

The attaching of the front glass to the door frame includes applying an adhesive to the door frame mounted to a door frame mounting jig; lifting the front glass mounted to the front glass mounting jig in an absorbing manner, and then mounting onto the door frame mounted to the door frame mounting jig; moving the door frame mounting jig to a compression jig; attaching the front glass to the door frame by using the compression jig; separating the door frame mounting jig from the compression jig, and moving to an initial position; and separating an assembly of the front glass attached to the door frame from the door frame mounting jig.

In order to achieve the third aspect and in accordance with the purpose of this specification, the adhesive may be formed in the same color as the opaque region.

An adhesive filling groove for filling the adhesive may be formed at the door frame. And the adhesive filling groove may include an adhesive application part configured to provide a space for applying the adhesive, and formed to enclose the opening; and adhesive collection parts formed to extend in parallel along the adhesive application part, at both sides of the adhesive application part, so as to collect the adhesive leaking to the both sides of the adhesive application part.

The align mark may be arranged to be overlapped with the adhesive application part.

In order to achieve the fourth aspect and in accordance with the purpose of this specification, as embodied and broadly described herein, there is provided a method for fabricating a door provided at a laundry treating apparatus, the method comprising: mounting a front glass to a front glass mounting jig, and mounting a door frame to a door frame mounting jig; applying an adhesive to the door frame; lifting the front glass by absorption, and then mounting onto the door frame; moving the door frame mounting jig to a compression jig; attaching the front glass to the door frame by using the compression jig; separating the door frame mounting jig from the compression jig, and moving to an initial position; and separating an assembly of the front glass attached to the door frame, from the door frame mounting jig, wherein in the applying of the adhesive to the door frame, the adhesive is applied along an adhesive filling groove formed to enclose an opening of the door frame, plural times in a divided manner.

The adhesive applied along the adhesive filling groove plural times in the divided manner may be distinguished from each other by a predetermined separation interval.

In the applying of the adhesive to the door frame, the adhesive may be applied at least 4 times.

The adhesive filling groove may include an adhesive application part configured to provide a space for applying the adhesive, and formed to enclose the opening; and adhesive collection parts formed to extend in parallel along the adhesive application part, at both sides of the adhesive application part, so as to collect the adhesive leaking to the both sides of the adhesive application part.

In the attaching of the front glass to the door frame by using the compression jig, and the separating of the door frame mounting jig from the compression jig and moving to the initial position, a part of the adhesive filled in an adhesive gun may be discarded, so as to prevent a blocking of a hole of the adhesive gun which applies the adhesive.

In the attaching of the front glass to the door frame by using the compression jig, and the separating of the door frame mounting jig from the compression jig and moving to the initial position, the amount of the adhesive to be discarded may be set to be larger than the amount of the adhesive to be applied in the applying of the adhesive to the door frame.

In order to achieve the fourth aspect and in accordance with the purpose of this specification, as embodied and broadly described herein, there is provided a laundry treating apparatus, comprising: a body having a laundry introduction opening; and a door configured to open and close the laundry introduction opening, wherein the door includes: a door frame rotatably coupled to the body, having an opening which faces the laundry introduction opening in a closed state of the door, and having an adhesive filling groove formed to enclose the opening; a front glass attached to the door frame to thus form a front appearance of the door; and an adhesive applied to the adhesive filling groove, and configured to attach the front glass to the door frame, wherein the adhesive is applied plural times along the adhesive filling groove with a separation interval.

The adhesive filling groove may include an adhesive application part configured to provide a space for applying the adhesive, and formed to enclose the opening; and adhesive collection parts formed to extend in parallel along the adhesive application part, at both sides of the adhesive application part, so as to collect the adhesive leaking to the both sides of the adhesive application part.

The adhesive application part may be formed in a ring shape having a preset radius.

A center of the adhesive application part may correspond to a center of the front glass.

The front glass may be formed of a glass material, and may be formed as a complete circle having a preset radius.

The front glass may be formed such that a front surface and a rear surface thereof are flat.

The adhesive filling groove may be formed in a ring shape having a preset radius, and a center of the adhesive filling groove may correspond to a center of the front glass.

The front glass may include a transparent region corresponding to the opening; an opaque region formed to enclose the transparent region; and a transparent align mark formed in the opaque region, and configured to guide an attachment position of the front glass to the door frame. And the adhesive may be applied (or disposed) to cover the align mark.

The adhesive may be formed in the same color as the opaque region.

Firstly, since the front glass formed of a glass material is formed as a complete circle and the front surface and the rear surface thereof are formed to be flat, a sophisticated feeling of the door may be more enhanced than in the conventional door cover formed of a synthetic resin material and formed as an incomplete circle having a convex front surface.

Secondly, when the front glass is mounted to the front glass mounting jig, the guide mark formed at the front glass mounting jig is aligned to be seen through the transparent align mark formed in the opaque region of the front glass. This may allow an alignment between the front glass and the door frame.

Thirdly, the adhesive is arranged to cover the align mark, and is formed in the same color as the opaque region. This may allow the align mark for the alignment not to be discerned easily from the outside of the door. Accordingly, the appearance of the door may be enhanced.

Fourthly, in the applying of the adhesive to the door frame, the adhesive is applied along the adhesive application part formed to enclose the opening of the door frame, plural times in a divided manner. This may minimize usages of the adhesive for attachment between the front glass and the door frame, and may prolong time taken for the adhesive filled in the adhesive gun to harden.

Further, in the attaching of the front glass to the door frame by using the compression jig, and the separating of the door frame mounting jig from the compression jig and moving to the initial position, a part of the adhesive filled in the adhesive gun is discarded. This may prevent a blocking of a hole of the adhesive gun for applying the adhesive.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a body having a first opening; and a door configured to open and close the first opening, wherein the door includes:

a door frame rotatably coupled to the body, and having a second opening that faces the first opening when the door is in a closed state; and a front glass to couple to the door frame and provide a front appearance of the door, wherein the front glass is formed in a circular shape, and a rear surface of the front glass is flat, and wherein the front glass includes:

a transparent region corresponding to the second opening of the door frame;

an opaque region to at least partially surround the transparent region; and a transparent alignment window provided in the opaque region, and configured to align the front glass to the door frame when the front glass is to be coupled to the door frame, wherein a center of the transparent region is eccentrically disposed from a center of the front glass toward an upper side of the front glass, and a radial width of the opaque region of the front glass based on the center of the front glass increases from an upper part of the front glass to a lower part of the front glass, wherein an adhesive application area is provided to the door frame, adhesive is applied to the adhesive application area and is configured to cover the transparent alignment window which overlaps the adhesive application area.

2. The laundry treating apparatus of claim 1, wherein the transparent alignment window is configured to provide the front glass to a preset position inside the door frame in order to prevent the front glass from rotating at the preset position.

3. The laundry treating apparatus of claim 1, wherein the transparent alignment window is lower than a center line passing horizontally in a radial direction through the center of the front glass.

4. The laundry treating apparatus of claim 1, wherein the transparent alignment window is to have a circular shape so as to contact an outer end of the front glass.

5. The laundry treating apparatus of claim 1, wherein the transparent alignment window is to have a polygonal shape positioned such that one edge contacts an outer end of the front glass.

6. The laundry treating apparatus of claim 1, wherein the door frame includes:

an outer frame having an outer circumferential part configured to enclose an outer side surface of the front glass; and an inner frame coupled to the outer circumferential part of the outer frame, and the inner frame coupled to an outer periphery of a door window.

7. The laundry treating apparatus of claim 6, wherein an align guide is provided at the outer frame, and is provided at a position corresponding to the transparent alignment window.

8. The laundry treating apparatus of claim 1, wherein a mounting guide is provided in a ring shape at the door frame, the mounting guide to enclose an outer circumferential surface of the front glass.

9. The laundry treating apparatus of claim 1, further comprising the adhesive between the door frame and the front glass, and configured to attach the front glass to the door frame.

10. The laundry treating apparatus of claim 9, wherein a groove for receiving the adhesive is provided at the door frame, wherein the groove includes:

the adhesive application area configured to receive the adhesive, and configured to enclose the second opening; and adhesive collection grooves to extend along both sides of the adhesive application area, so as to collect the adhesive leaking from the sides of the adhesive application area.

11. The laundry treating apparatus of claim 9, wherein the adhesive is formed in a same color as the opaque region.

12. The laundry treating apparatus of claim 1, wherein a mounting guide is provided in a ring shape at the door frame, the mounting guide to enclose an outer circumferential surface of the front glass, wherein a groove is provided on the door frame for receiving the adhesive that attaches the front glass to the door frame, and wherein the groove is formed in a ring shape, along a circumference of the mounting guide, so as to enclose the second opening.

13. The laundry treating apparatus of claim 12, wherein an interval between the mounting guide and the groove is maintained along the circumference of the mounting guide.

14. The laundry treating apparatus of claim 12, wherein the groove includes:

the adhesive application area configured to receive the adhesive, and to enclose the second opening; and adhesive collection grooves to extend along both sides of the adhesive application area, so as to collect the adhesive leaking from the sides of the adhesive application area.

15. The laundry treating apparatus of claim 1, wherein the center of the transparent region is located at a position corresponding to a center of the second opening.

16. A laundry treating apparatus, comprising:

a body; and a door that includes:

a door frame to be rotatably coupled to the body, and having an opening; and a front glass to couple to the door frame and provided at a front of the door, and wherein the front glass includes:

a transparent region configured to correspond to the opening;

an opaque region to at least partially enclose the transparent region; and an alignment window provided in the opaque region, and configured to align the front glass to the door frame when the front glass is to be coupled to the door frame, a center of the transparent region is disposed at a position corresponding to a center of the opening, and the center of the transparent region is upward from a center of the front glass, wherein an adhesive application area is provided to the door frame, adhesive is applied to the adhesive application area and is configured to cover the alignment window which overlaps the adhesive application area.

17. A laundry treating apparatus, comprising:

a body having a first opening; and a door configured to open and close the first opening, wherein the door includes:

a door frame rotatably coupled to the body, and having a second opening that faces the first opening when the door is in a closed state; and a front glass to couple to the door frame and provide a front appearance of the door, wherein the front glass is formed in a circular shape, and a rear surface of the front glass is flat, and wherein the front glass includes:

a transparent region corresponding to the second opening of the door frame;

an opaque region to at least partially surround the transparent region; and a transparent alignment window provided in the opaque region, and configured to align the front glass to the door frame when the front glass is to be coupled to the door frame, wherein a center of the transparent region is eccentrically disposed from a center of the front glass toward an upper side of the front glass, wherein an adhesive application area is provided to the door frame, adhesive is applied to the adhesive application area and is configured to cover the transparent alignment window which overlaps the adhesive application area.

* * * * *